US008906198B2

(12) United States Patent
Sabourin et al.

(10) Patent No.: US 8,906,198 B2
(45) Date of Patent: Dec. 9, 2014

(54) METHOD FOR PRODUCTION OF MICRO FIBRILLATED CELLULOSE

(71) Applicant: Andritz Inc., Glens Falls, NY (US)

(72) Inventors: Marc Sabourin, Beavercreek, OH (US); Antti Luukkonen, Wien (AT)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 14/050,799

(22) Filed: Oct. 10, 2013

(65) Prior Publication Data

US 2014/0124150 A1 May 8, 2014

Related U.S. Application Data

(60) Provisional application No. 61/796,101, filed on Nov. 2, 2012.

(51) Int. Cl.
*D21C 9/00* (2006.01)
*D21D 1/20* (2006.01)

(52) U.S. Cl.
CPC . *D21C 9/001* (2013.01); *D21D 1/20* (2013.01)
USPC ..... 162/9; 162/26; 162/72; 162/187; 241/28

(58) Field of Classification Search
CPC ..... D21H 11/18; D21H 11/20; D21H 17/005; D21C 5/005; D21C 9/007; D21C 9/001; D21D 1/20
USPC ..... 162/9, 24, 26, 72, 187; 241/21, 28
See application file for complete search history.

(56) References Cited

U.S. PATENT DOCUMENTS

| | | | | |
|---|---|---|---|---|
| 6,899,791 | B2 * | 5/2005 | Sabourin | 162/23 |
| 7,300,540 | B2 * | 11/2007 | Sabourin et al. | 162/23 |
| 8,231,764 | B2 * | 7/2012 | Husband et al. | 162/183 |
| 8,647,468 | B2 * | 2/2014 | Heiskanen et al. | 162/9 |
| 8,728,273 | B2 * | 5/2014 | Heiskanen et al. | 162/157.6 |
| 8,734,611 | B2 * | 5/2014 | Sabourin et al. | 162/28 |
| 8,778,134 | B2 * | 7/2014 | Vehvilainen et al. | 162/9 |
| 2005/0194477 | A1 * | 9/2005 | Suzuki | 241/20 |
| 2009/0288789 | A1 * | 11/2009 | Sabourin et al. | 162/24 |
| 2012/0135506 | A1 * | 5/2012 | Heiskanen et al. | 435/277 |
| 2012/0136146 | A1 * | 5/2012 | Heiskanen et al. | 536/56 |
| 2012/0160433 | A1 * | 6/2012 | Vehvilainen et al. | 162/24 |
| 2013/0017394 | A1 * | 1/2013 | Hua et al. | 428/401 |
| 2013/0053454 | A1 * | 2/2013 | Heiskanen et al. | 514/781 |
| 2014/0124150 | A1 * | 5/2014 | Sabourin et al. | 162/9 |

FOREIGN PATENT DOCUMENTS

| | | | |
|---|---|---|---|
| EP | 1538257 | | 6/2005 |
| EP | 2103734 | A1 * | 9/2009 |
| WO | WO 9722749 | A1 * | 6/1997 |

(Continued)

OTHER PUBLICATIONS

Sulzer, "Medium Consistency Technology," Date unknown, pp. 1-8.*

(Continued)

*Primary Examiner* — Jose Fortuna
(74) *Attorney, Agent, or Firm* — Kerri Hochgesang; Robert Joseph Hornung

(57) ABSTRACT

A method for producing micro fibrillated cellulosic material from pulp where multiple passes through a medium consistency refiner are made either singularly or in combination with low consistency refiners and high consistency refiners.

7 Claims, 6 Drawing Sheets

(56) References Cited

FOREIGN PATENT DOCUMENTS

| | | | |
|---|---|---|---|
| WO | WO 2007091942 | A1 * | 8/2007 |
| WO | 2012/097446 | A1 | 7/2012 |
| WO | WO 2012097446 | A1 * | 7/2012 |
| WO | WO 2014070452 | A1 * | 5/2014 |

OTHER PUBLICATIONS

International Search Reported cited in PCT/US2013/065201 mailed Jan. 22, 2014.

Siro et al, Microfibrillated cellulose and new nanocomposite materials: a review, Cellulose, pp. 459-494, vol. 17, Springer Science+Business Media B.V., (Feb. 21, 2010).

Spence, "Processing and Properties of Microfibrillated Cellulose", Dissertation, North Carolina State University, (2011).

Paakko et al, "Enzymatic hydrolysis combined with mechanical shearing and high-pressure homogenization for nanoscale cellulose fibrils and strong gels", Biomacromolecules, 2007, vol. 8, pp. 1934-1941.

Wagberg et al, "The build-up of polyelectrolyte multilayers of microfibrillated cellulose and cationic polyelectrolytes", Langmuir, American Chemical Society vol. 24 (3), pp. 784-795 (2008).

* cited by examiner

METHOD FOR PRODUCTION OF MICRO FIBRILLATED CELLULOSE

RELATED APPLICATION

This application claims priority to and incorporates by reference provisional application 61/796,101, filed Nov. 2, 2012.

BACKGROUND

Embodiments of the invention relate to methods to produce micro fibrillated cellulosic material from pulp material.

Cellulose is an organic compound that makes up the structural component of the cell wall in plants and many forms of algae. It is also the most common organic compound on Earth, as well as Earth's most plentiful renewable resource. Micro fibrillated cellulose ("MFC") comprises a series of micro fibrils that have been separated from their original cellulose fiber. MFC fibers are extremely fine, usually comprising of numerous cellulose chains. MFC typically has a width ranging from 5-20 nanometers and a length ranging from tens of nanometers up to several microns. MFC can be produced from any cellulose source; however, wood pulp is the most commonly used feed material in MFC production.

The increased surface area of MFC allows it to have a much higher number of hydrogen bonds binding the fibrils together, and because of this, MFC has uniquely high strength properties. Additionally, because of an increased ability to use abundant and renewable feed material to produce MFC, MFC has gained attention as a feedstock for material with multiple uses including packaging and composite reinforcement, and has shown potential to replace petroleum-derived polymers.

Many processes have been identified for producing MFC. These processes include cryocrushing, homogenization, microfluidization, and micro-grinding. In cryocrushing, the feed material is frozen using liquid nitrogen prior to high impact forces being applied to separate the fibrils from the cell wall.

In the homogenization process, the feed material undergoes rapid pressure decreases; typically the pressure drop is around 8,000 psi. Homogenization can be scaled for larger production and can be run continuously. Homogenization is a commonly used process for MFC production and one of the easier processes to scale up to larger production. This process can be very energy intensive, commonly requiring greater than 30 MWh/ton. In order to reduce the energy requirements for the homogenization process to produce MFC, carboxymethylation, TEMPO-mediation oxidation and many other chemical pre-treatment steps have been used, but these pre-treatment steps can be very expensive.

Microfluidizers compress the feed material and operate at a constant shear. Microfluidizers can be manufactured with differing geometries in order to produce materials with varying size.

Micro-grinding is similar to disc refining. During this process, feed material is pushed through a gap between a rotating and a stationary disc. These discs have grooves that contact and separate the fibers. The equipment used for the micro-grinding process may have rotor and stator disc surfaces coated with silicon carbide to assist in grinding.

A micro-grinding process to produce MFC has been discussed in EP 1538257 ("EP '257") to Japan Absorbent Technology Institute. EP '257 presents a method to produce micro fibrillated cellulose using a disc refiner in recirculation beginning with pulp produced from cellulosic material. This patent describes a process for obtaining MFC produced from pulp derived from cellulosic material by mechanically refining the pulp with a disc refiner. The MFC produced from the mechanical refining of the pulp described in EP '257 have fibers with a length of less than 0.2 mm and a water retention value of 10 mL/g or greater. In this process, prior to the mechanical refining of the pulp feedstock treatment, pulp must be diluted to a consistency of 1% to 6%. A mixture of water and ethanol may be used in the described process to reduce viscosity and improve the transferability of the pulp. Using the process of EP '257, MFC is said to be produced after at least ten passes, also known as circulations, through the mechanical refiner, although more passes through the refiner are suggested, resulting in high overall energy consumption.

Conventional methods resisted using medium and high consistency refiners due to the concerns of product quality, such as size and breakage versus desired product properties. Additionally, conventional processes require high energy consumption for refining processes to achieve the desired product, developing a lower energy consumption process is desirable.

Additional information for MFC production is disclosed in the following articles: "*Enzymatic hydrolysis combined with mechanical shearing and high-pressure homogenization for nanoscale cellulose fibrils and strong gels*" by Pääkkö, M., M. Ankerfors, H. Kosonen, A. Nykänen, S. Ahola, M. Österberg, J. Ruokolainen, J. Laine, P. T. Larsson, O. Ikkala, and T. Lindström (2007) published in the *Biomacromolecules* 8 (6): 1934-1941; Siró, István, and David Plackett. "*Micro fibrillated cellulose and new nanocomposite materials: a review.*". *Springer Science+Business Media B.V.* Cellulose (2010) 17: 459-494. Web. 4 Sep. 2012; *"Processing and Properties of Micro fibrillated Cellulose*", by Spence, Kelley Lynn; Diss. North Carolina State University, 2011. Web; "The build-up of polyelectrolyte multilayers of microfibrillated cellulose and cationic polyelectrolytes", by Wågberg, Lars; Gero Decher, Magnus Norgren, Tom Lindström, Mikael Ankerfors, and Karl Axnäs (2008), *Langmuir* 24 (3): 784-795.

BRIEF SUMMARY

A process for producing MFC material having an average fiber length of 0.2 mm or less, with 20 ml/g or more water retention, while reducing the specific energy consumption ("SEC") for the overall process, has been developed using mechanical refining equipment. The mechanical refiners used in this process can be a single disc refiner, a double disc refiner, a conical refiner, a rotating cylinder refiner, or other types of refiners used to mechanically grind or process cellulosic or lignocellulosic material (referred to herein collectively as "cellulosic material") to produce individual fibers and smaller fibrillar elements. The feed material for this process may be previously treated cellulosic material (such as wood chips, annual plants, etc.) formed into pulp. The previous treatment of the cellulosic material to produce pulp used as the feed material for MFC can be a result of chemical digestion, such as Kraft cooking, sulfite cooking, soda cooking, biological, enzymatic treatment, etc., mechanical refining, a combination of chemical digestion and refining, or other known processes. An optional pre-treatment step is to introduce enzymes (for example cellulase enzymes) to the pulp after dilution or with the dilution liquid to dilution to either a medium consistency or low consistency prior to the medium or low consistency refining step. These enzymes may be introduced either while agitating the pulp or while not agitating the pulp. This enzyme pre-treatment step should be conducted at a temperature favorable to the enzyme activity and for a time, such as one hour, sufficient for the enzymes to perform the desired effect on the pulp.

The feed pulp material from cellulosic material may be diluted to a solids consistency of 6% to 15% and is frequently referred to as medium consistency pulp. This medium consistency pulp may be fed into a refiner capable of handling medium consistency pulp slurry. This refiner can be a medium consistency refiner, such as a single disc refiner or a double disc refiner with opposing discs, where at least one disc is movable relative to the other disc, or a conical refiner or a rotating cylinder refiner or other suitable refiner. The feed pulp material fed into the refiner may be pushed through a gap between the discs or opening in the conical or other suitable refiner where the pulp material may be subjected to a grinding action to reduce the fiber length, fibrillate, and separate the fibers into individual strands and fibrillar elements than in the feed pulp material. A number of passes through the refiner, desirably more than five passes, may be required to obtain the desired MFC product. In accordance with the present disclosure, the MFC fiber properties may have an average fiber length of 0.2 mm or less and 20 ml/g or higher water retention.

In another embodiment of the new process, feed pulp material generated from cellulosic material to produce a desirable feed pulp material, may be diluted to a solids consistency of 6% to 15% (frequently referred to as medium consistency pulp) and may be fed to a first refiner, such as a refiner capable of handling a medium consistency pulp slurry, typically either a single disc or double disc refiner with opposing discs (or conical refiner or rotating cylindrical refiner or other suitable refiner), with at least one disc being movable relative to the other disc, or a first conical refiner or rotating cylindrical refiner or other suitable refiner. The pulp material fed to the first medium consistency refiner may be pushed through a gap between the discs or opening in the conical refiner where the pulp material can be submitted to a grinding action to reduce the fiber length, fibrillate, and separate the fibers into individual strands and fibrillar elements than in the feed pulp material. The pulp material may make a number of passes through the first medium consistency refiner, possibly more than five passes through the first medium consistency refiner. Given the wide range of fineness of MFC product ranges, the number of passes can be quite substantial, and in some cases greater than fifty, depending on the final average length and other characteristics for the MFC. After passing through the first medium consistency refiner, the pulp material may be diluted to a solids consistency of less than 6% and fed to a second refiner which may be a low consistency refiner, capable of handling pulp material at a consistency of less than 6%. This second refiner may be a single disc refiner, a double disc refiner, a conical refiner, rotating cylindrical refiner, or other suitable refiner). The pulp material undergoes refining in the second refiner, which may be a low consistency refiner, for a number of passes, possibly fewer than ten passes through the second refiner, which may be a low consistency refiner, to obtain the desired MFC product. The resultant MFC product has an average fiber length of 0.2 mm or less and 20 ml/g or more water retention.

The process for producing the MFC material comprises the following steps: a) using feed pulp material produced from cellulosic material; b) diluting the feed pulp material to form medium consistency pulp; c) feeding the medium consistency pulp into a medium consistency refiner; d) using the medium consistency refiner to reduce the fiber length, fibrillate, and separate the fibers into strands and fibrillar elements; e) removing the medium consistency pulp from the refiner; and f) repeating steps c) through e) at least four times to produce MFC material wherein each succession of steps c) through e) uses the removed medium consistency pulp from the prior succession of steps c) through e).

In another embodiment, the process for producing MFC may further comprise: g) diluting the feed pulp material into low consistency pulp, h) feeding the low consistency pulp into a low consistency refiner, i) using the low consistency refiner to reduce the fiber length and fibrillate, and separate the fibers into strands and fibrillar elements, j) removing the low consistency pulp from the refiner, and k) repeating steps h) through j) less than ten times to produce MFC material wherein each succession of steps h) through j) uses the removed low consistency pulp from the prior succession of steps h) through j).

In another embodiment, a single refiner may be used for both the medium and low consistency refining passes. This may be accomplished by diluting while in recirculation mode, i.e., starting at medium consistency in recirculation for at least five passes (pulp material having 6% to 15% consistency), then recirculating at less than 6% consistency for fewer than ten passes.

In yet another embodiment, the process for producing MFC material comprises the steps of: a) using feed pulp material from cellulosic material processed to a high consistency feed pulp; b) pre-treating the high consistency feed pulp in high consistency refiner for a single pass through the high consistency refiner; c) removing the high consistency feed pulp from the high consistency refiner; d) diluting the high consistency feed pulp to form medium consistency pulp; e) feeding the medium consistency pulp into a medium consistency refiner; f) using the medium consistency refiner to reduce the fiber length, fibrillate, and separate the fibers into strands and fibrillar elements; g) removing the medium consistency pulp from the refiner; and h) repeating steps e) through g) at least four times to produce the MFC material, wherein each succession of steps e) through g) uses the removed medium consistency pulp produced by the prior succession of steps e) through g).

In another embodiment, the process for producing MFC material may further comprise: i) diluting the feed pulp material to a low consistency pulp, j) feeding the low consistency pulp into a low consistency refiner, k) using the low consistency refiner to reduce the fiber length, fibrillate, and separate the fibers into strands and fibrillar elements, l) removing the low consistency pulp from the refiner, and m) repeating steps j) through l) less than ten times to produce the MFC material, wherein each succession of steps j) through l) uses the removed low consistency pulp produced by the prior succession of steps j) through l).

High consistency feed pulp material may be feed pulp material with a solids consistency of greater than 15%. In some exemplary embodiments, the feed pulp material may have a solids consistency of greater than 20%. In other exemplary embodiments, the feed pulp material may have a solids consistency of greater than 35%. The feed pulp material may be fed to a pre-treatment refiner, which is also known as a pre-treatment high consistency refiner. This pre-treatment high consistency refiner may be a single disc refiner, a double disc refiner, a conical refiner, a rotating cylindrical refiner, or other suitable refiner. The feed pulp may be fed into the high consistency refiner for a single pass. The specific energy consumption of this pre-treatment high consistency refining step may be 600 KWh/ton or less. Once through the pre-treatment high consistency refiner, the pulp material may be diluted to a solids consistency of 6% to 15% and may be fed to a medium consistency refiner. The pulp material fed to the medium consistency refiner may be pushed through a gap between the discs or opening in the conical refiner where the pulp material can be submitted to a grinding action to reduce the fiber length, fibrillate, and separate the fibers into individual strands and fibrillar elements than in the feed pulp material. A number of passes through the medium consistency refiner may be made, and in some embodiments more than five passes may be made through the medium consistency refiner. The degree of fineness, in this case defined by the average fiber length, should be fine enough such that the final MFC product properties can be achieved with less than ten passes of subsequent low consistency refining. After passing through the medium consistency refiner for five or more passes, the pulp material may be diluted to a solids consistency of less than 6% and fed to a low consistency refiner. The pulp material may undergo refining in the low consistency refiner for a number of passes. Fewer than ten passes may be made through the low consistency refiner, in order to obtain the desired MFC product. The final MFC product resulting from the disclosed process may have less than 0.2 mm average fiber length and greater than 20 ml/g water retention. As indicated earlier, a single refiner can also be used for both the medium and low consistency refining passes using on-line dilution while in recirculation mode. In this example embodiment, the pump through refiner is usually configured to operate on both medium and low consistency fiber suspensions.

In another embodiment of the process, a feed pulp material with a solids consistency of greater than 15% may be used. In some exemplary embodiments, the feed pulp material may have a solids consistency of greater than 20%. In other exemplary embodiments, the feed pulp material may have a solids consistency of greater than 35%. The feed pulp material may be fed into a pre-treatment high consistency refiner for a single pass. The specific energy consumption of this pre-treatment high consistency refining step may be 600 KWh/ton or less. When through the pre-treatment high consistency refiner, the pulp material may be diluted to a solids consistency of 6% to 15% and may be fed into a medium consistency refiner. The pulp material fed into the medium consistency refiner may be pushed through a gap between the discs or opening in the conical refiner where the pulp material may be submitted to a grinding action to reduce the fiber length, fibrillate, and separate the fibers into individual strands and fibrillar elements than in the feed pulp material. A number of passes through the medium consistency refiner may be made, specifically more than five passes, to obtain the desired MFC product. The final MFC product may have an average fiber length of 0.2 mm or less with 20 ml/g or more water retention.

In still another embodiment, a process for producing MFC material comprises the steps of: a) using a feed pulp material from cellulosic material processed to a high consistency feed pulp; b) pre-treating the high consistency feed pulp in a high consistency refiner for a single pass through the high consistency refiner; c) removing the high consistency feed pulp from the high consistency refiner; d) diluting the high consistency feed pulp to form a low consistency pulp; e) feeding the low consistency pulp into a low consistency refiner; f) using the low consistency refiner to reduce the fiber length, fibrillate, and separate the fibers into strands and fibrillar elements; g) removing the low consistency pulp from the refiner; and h) repeating steps e) through g) less than ten times to produce the MFC material, wherein each succession of steps e) through g) uses the removed low consistency pulp produced by the prior succession of steps e) through g).

In still another embodiment, the feed pulp material may have a solids consistency of greater than 15%. In some exemplary embodiments, the feed pulp material may have a solids consistency of greater than 20%. In other exemplary embodiments, the feed pulp material may have a solids consistency of greater than 35%. The feed pulp material may be fed to a high consistency pre-treatment refiner for a single pass. The specific energy consumption of this pre-treatment high consistency refining step may be 600 KWh/ton or less. Once through the pre-treatment high consistency refiner, the pulp material may be diluted to a solids consistency of less than 6% and fed to a second refiner, which may be a low consistency refiner, capable of handling pulp material at a consistency of less than 6%. The pulp material may undergo refining in the low consistency refiner for a number of passes, possibly fewer than ten passes, to obtain the desired MFC product. The final refined product may have an average fiber length of 0.2 mm or less with 20 ml/g or more water retention. In some instances, the MFC specification may call for refining to less than an average fiber length of 50 microns. For all embodiments the MFC product produced during the refining steps may undergo subsequent process treatments as deemed desirable for a given end-product application.

In another example embodiment, a method to produce micro fibrillated cellulose (MFC) material has been conceived comprising: diluting a pulped cellulosic material to form a medium consistency pulp; feeding the medium consistency pulp into a medium consistency refiner; refining the medium consistency pulp in a medium consistency refiner to produce refined medium consistency pulp; removing the refined medium consistency pulp from the refiner; and repeating at least four times the feeding, the refining and the removing steps to produce MFC material, wherein in each repetition the feeding of the medium consistency pulp is performed with the refined medium consistency pulp from the prior repetition.

An additional option consistent with the disclosed process is to add enzymes. Cellulase enzymes may be desirable, but other acceptable enzymes could be used. Enzymes may be added to the pulp typically before dilution, but could be added after dilution, or even with the dilution liquid. These enzymes may be added to either a medium consistency slurry of pulp having a solids consistency of between 6% to 15% or to a low consistency slurry of pulp having a solids consistency of less than 6% but prior to the subsequent refining step. The pre-treatment with enzymes generally comprises adding the enzymes to the pulp slurry at a temperature of between about 30° C. and about 60° C. for a duration of between about 5 minutes to about 100 minutes, or about 30 minutes to about 90 minutes, or about 45 minutes to about 60 minutes. The contact of enzymes and pulp slurry may be in a tank, such as the tank where dilution of the pulp slurry occurs, but is not limited to a tank. The enzymes may be added with or without agitation of the pulp slurry. Suitable equipment generally permits for contacting the enzymes with the pulp slurry and sufficient retention time to allow for the desired reaction between the enzymes and the pulp slurry to occur.

DETAILED DESCRIPTION

Figure 1:
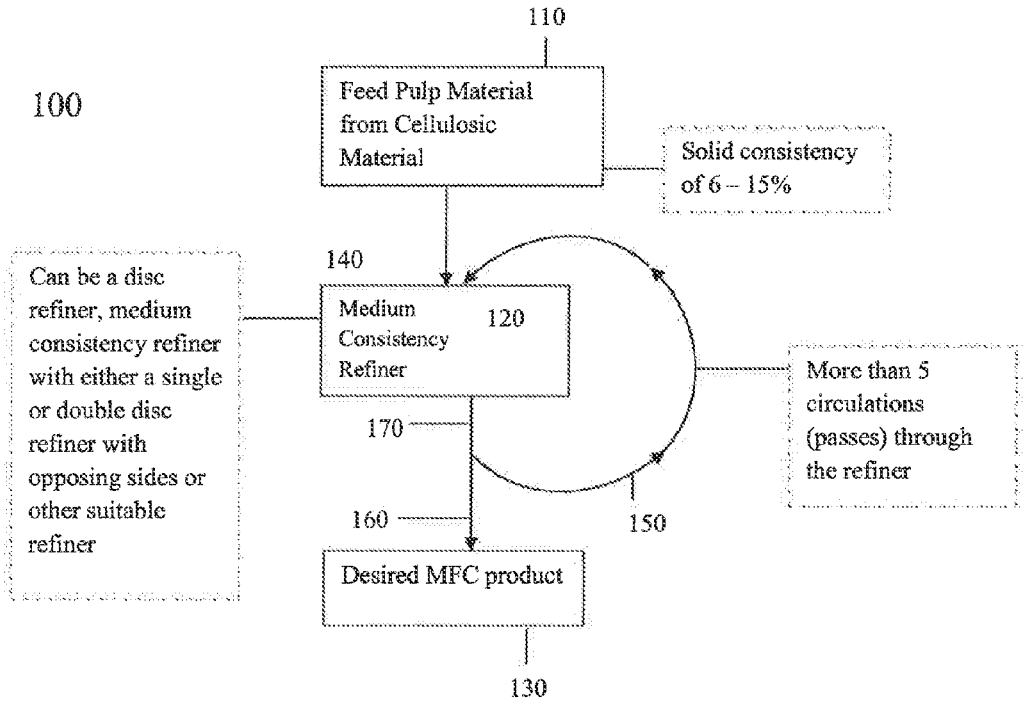
FIG. 1 shows exemplary process flow steps to produce MFC using a medium consistency refiner.

FIG. 1 shows a process for producing MFC 100. The medium consistency feed pulp material 110 may be cellulosic material which has been previously treated to produce pulp. Medium consistency feed pulp material 110 may have a solids consistency of 6% to 15%. The medium consistency feed pulp material 110 may be fed to a medium consistency refiner 120 where the pulp may be separated into small bundles or individual fibers. Medium consistency refiner 120 can be a single or double disc refiner with at least one rotating disc, conical refiner, rotating cylinder refiner, or other refiner capable of handling a mixture of solid (pulp) and liquid slurry with a solids consistency of between 6% and 15%, (a medium consistency refiner). The medium consistency feed pulp material 110 may be fed via line 140 to the inlet of the medium consistency refiner 120 and may move through the medium consistency refiner 120 to the outlet where it can be removed through line 170 and either returned to the medium consistency refiner 120 inlet via line 150 or removed from the process via line 160 as MFC product 130. In general, movement of the pulp material from the inlet to the outlet through the refiner is said to be a "pass." For MFC product 130 to be produced by using primarily a medium consistency refiner 120, more than five passes through the medium consistency refiner 120 may be required. Once the desired MFC product qualities are achieved, MFC product 130 can move through line 160 out of the refining step to MFC product tank (not shown), from which MFC may be sent to a collection reservoir for shipment or to subsequent processing steps. This embodiment in no way limits the method of any subsequent processing step or steps. It is understood in some applications that further processing may be required to generate desired end-product properties.

Figure 2:
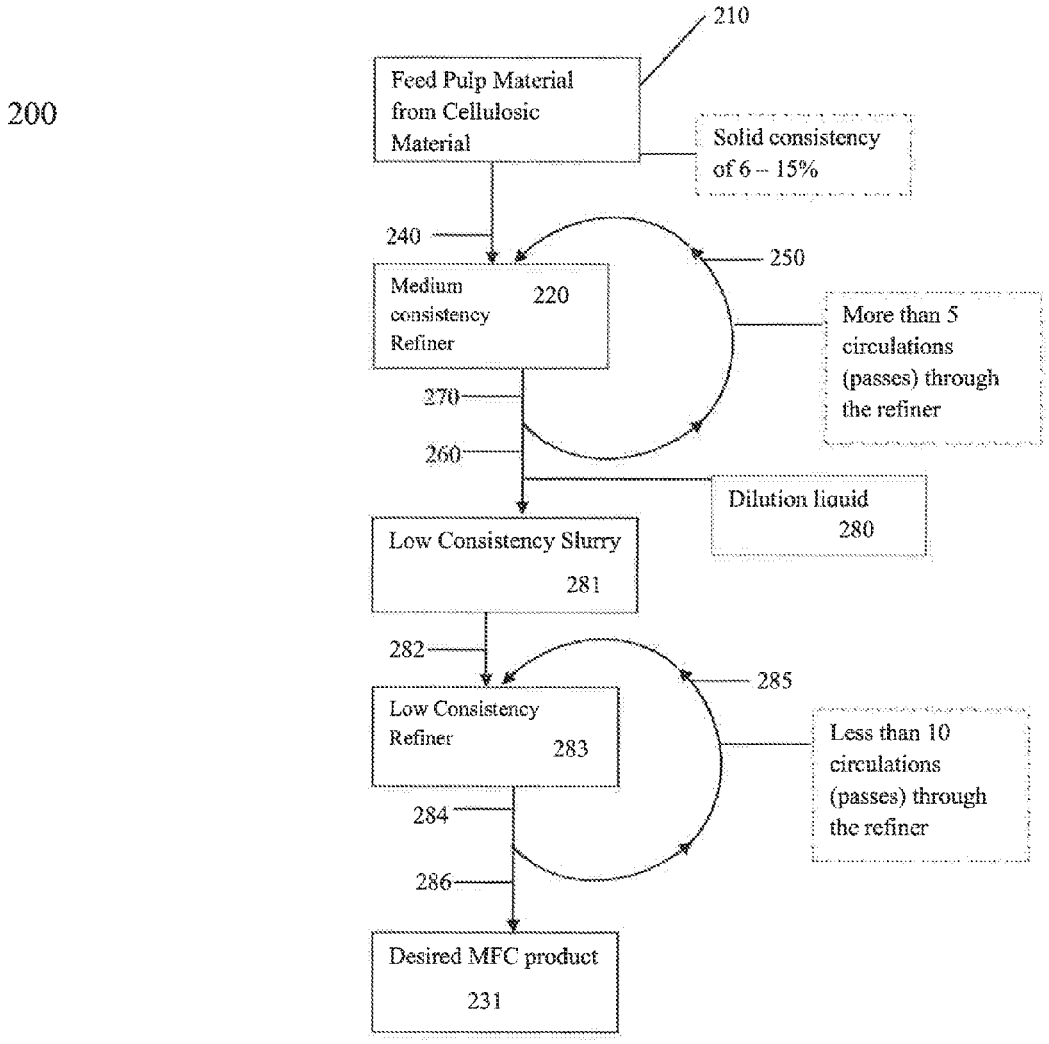
FIG. 2 shows exemplary process flow steps to produce MFC using a combination of medium consistency and low consistency refiners.

FIG. 2 shows the process to produce MFC 200 where a combination of medium consistency and low consistency refiners are used, equipment and streams common to FIG. 1 use similar item numbers. The medium consistency feed pulp material 210 may be cellulosic material which has been previously treated to produce pulp. Medium consistency feed pulp material 210 may have a solids consistency of 6% to 15%. The medium consistency feed pulp material 210 may be fed to a medium consistency refiner 220 where the pulp can be separated and fibrillated into small bundles or individual fibers. Medium consistency refiner 220 can be a single or double disc refiner with at least one rotating disc, a conical refiner, a rotating cylinder refiner, or other refiner capable of handling a mixture of solid (pulp) and liquid slurry with a solids consistency of between 6% and 15%. The medium consistency feed pulp material 210 may enter via line 240 into the inlet of the medium consistency refiner 220 and can move through the refiner to the outlet where it can be removed through line 270 and either returned to the refiner inlet via line 250 or removed from the process via line 260. Pulp material from medium consistency refiner 220 may make more than five passes, via line 250, until the desired intermediary properties are achieved, most typically defined by an average fiber length, but other properties such as water retention and viscosity may also be considered. The pulp material in line 260 from the medium consistency refiner 220 may then be diluted, using dilution liquid 280, to a low consistency slurry 281 having a solids consistency lower than 6%. The solids consistency may typically be between 1% and 6%. The low consistency slurry 281 may be transferred via line 282 to a low consistency refiner 283. As with medium consistency refiner 220, low consistency refiner 283 can be a single or double disc refiner with at least one rotating disc, a conical refiner, a rotating cylinder refiner, or other refiner capable of handling a mixture of solid (pulp) and liquid low consistency slurry 281 with a solids consistency of less than 6%. The solids consistency may typically be between 1% and 6%. The low consistency slurry 281 may enter the inlet, via line 282, of the low consistency refiner 283 and may move through the refiner to the outlet where it can be removed through line 284 and either returned to the low consistency refiner inlet via line 285 or removed from the process via line 286. In one exemplary embodiment, there may be less than ten passes through the low consistency refiner 283. In other exemplary embodiments, there may be less than nine passes through the low consistency refiner 283. In still other exemplary embodiments, there may be less than eight passes through the low consistency refiner 283. The final product criteria, typically average fiber length, water absorption, or viscosity may all be considered. MFC product 231 may be sent to a collection reservoir or may undergo subsequent processing. It is also understood that a single refiner may be used to conduct both the medium consistency and low consistency refining passes.

Figure 3:
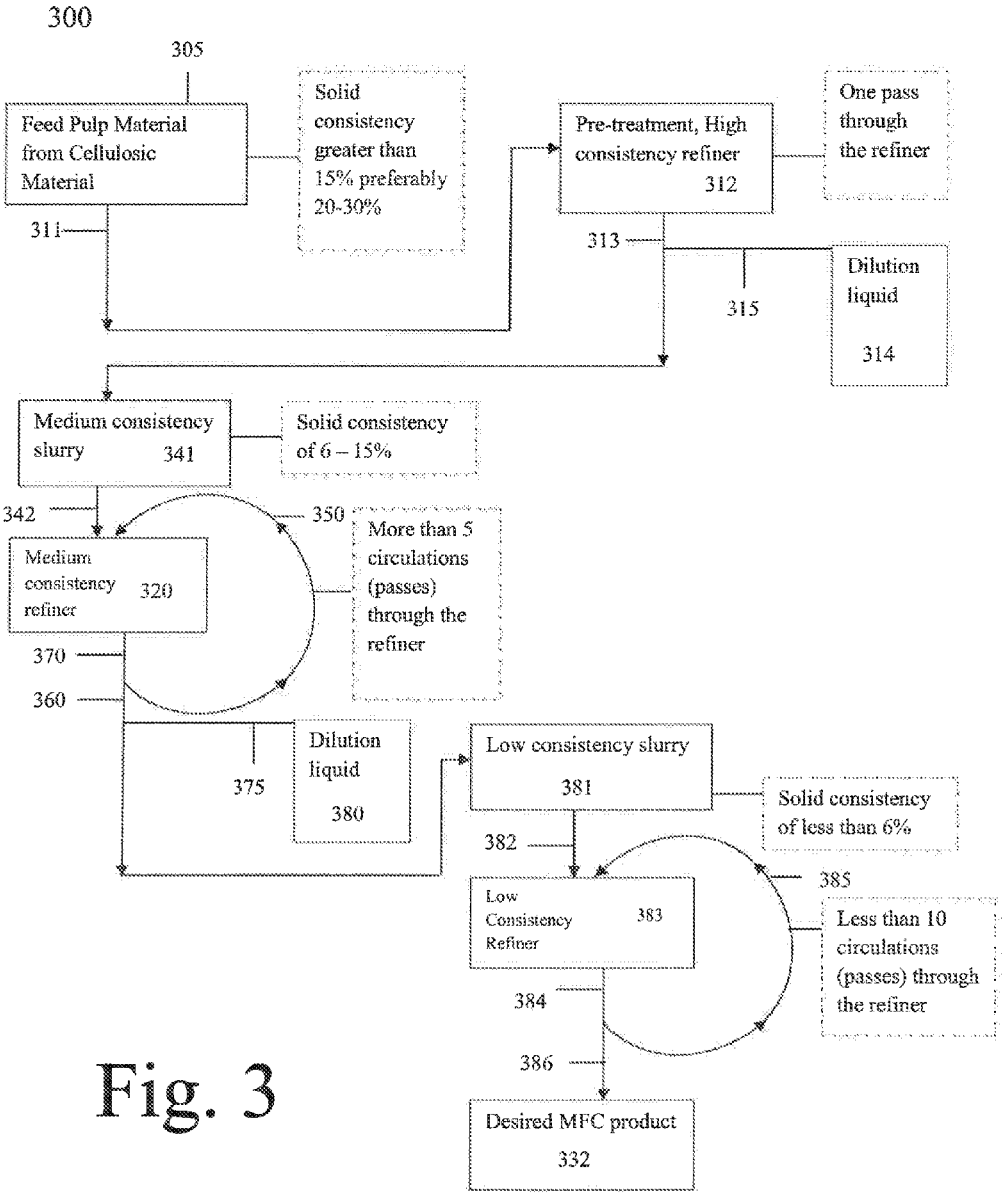
FIG. 3 shows exemplary process flow steps to produce MFC using a combination of high, medium and low consistency refiners.

FIG. 3 shows the process to produce MFC 300 where a combination of high consistency refiner pre-treatment and medium consistency and low consistency refiners are used, equipment and streams common to FIGS. 1 and 2 use similar item numbers. The high consistency feed pulp material 305 may be cellulosic material which has been previously treated to produce pulp. High consistency feed pulp material 305 may have a solids consistency of greater than 15%. In some exemplary embodiments, the feed pulp material may have a solids consistency of greater than 20%. In other exemplary embodiments, the feed pulp material may have a solids consistency of greater than 35%. The high consistency feed pulp material 305 may be fed via line 311 to a pre-treatment high consistency refiner 312. Pre-treatment in the high consistency refiner 312 is a single pass through the pre-treatment high consistency refiner 312. Upon removal from the pre-treatment high consistency refiner 312 via line 313, dilution liquid 314 (this dilution liquid can be the same as other liquids used throughout the invention) may be added to pulp material in line 313 via line 315 to form a pre-treated medium consistency slurry 341. The pre-treated medium consistency slurry 341 may have a solids consistency of between 6% and 15%. The pre-treated medium consistency pulp slurry 341 may be fed via line 342 to a medium consistency refiner 320 where the pulp may be separated into small bundles or individual fibers. Medium consistency refiner 320 can be a single or double disc refiner with at least one rotating disc, a conical refiner, a rotating cylinder refiner, or other refiner capable of handling a mixture of solid (pulp) and liquid, slurry with a solids consistency of between 6% and 15%. The pre-treated medium consistency slurry 341 may enter the inlet of the medium consistency refiner 320 and may move through the medium consistency refiner 320 to the outlet where it can be removed through line 370 and either returned to the medium consistency refiner 320 inlet via line 350 or continues through the process via line 360 (upon completion of the required passes through the medium consistency refiner 320). Pulp material from medium consistency refiner 320 may make more than five passes, via line 350, until the fibers are refined to the desired intermediary properties. When processing from the medium consistency refiner 320 is complete, dilution liquid 380 (dilution liquid 380 may be the same liquid as dilution liquid 314), may be added to pulp material in line 360 via line 375 to form a low consistency slurry 381. The low consistency slurry 381 may have a solids consistency lower than 6%. The solids consistency of the low consistency slurry 381 may typically be between 1% and 6%. The low consistency slurry 381 may be transferred via line 382 to a low consistency refiner 383. As with the medium consistency refiner 320, the low consistency refiner 383 can be a single or double disc refiner with at least one rotating disc, conical refiner, rotating cylinder refiner, or other refiner capable of handling a mixture of solid (pulp) and low consistency slurry 381 with a solids consistency of less than 6%. The solids consistency may typically be between 1% and 6%. The low consistency slurry 381, through line 382, enters the inlet of the low consistency refiner 383 and may move through the refiner to the outlet where it can be removed through line 384 and either is returned to the refiner inlet via line 385 or removed from the process via line 386 upon completion of the required passes through the low consistency refiner 383. In one embodiment, there may be less than ten passes through low consistency refiner 383. In other exemplary embodiments, there may be less than nine passes through the low consistency refiner 383. In still other exemplary embodiments, there may be less than eight passes through the low consistency refiner 383. The final product criteria, typically average fiber length, water absorption, or viscosity may all be considered and once the desired product criteria is achieved, the pulp material from the low consistency refiner 383 is removed from the process via line 386. MFC product 332 may be sent to a collection reservoir or may undergo subsequent processing. It is also again understood that a single refiner may be used to conduct both the medium consistency and low consistency refining passes.

Figure 4:
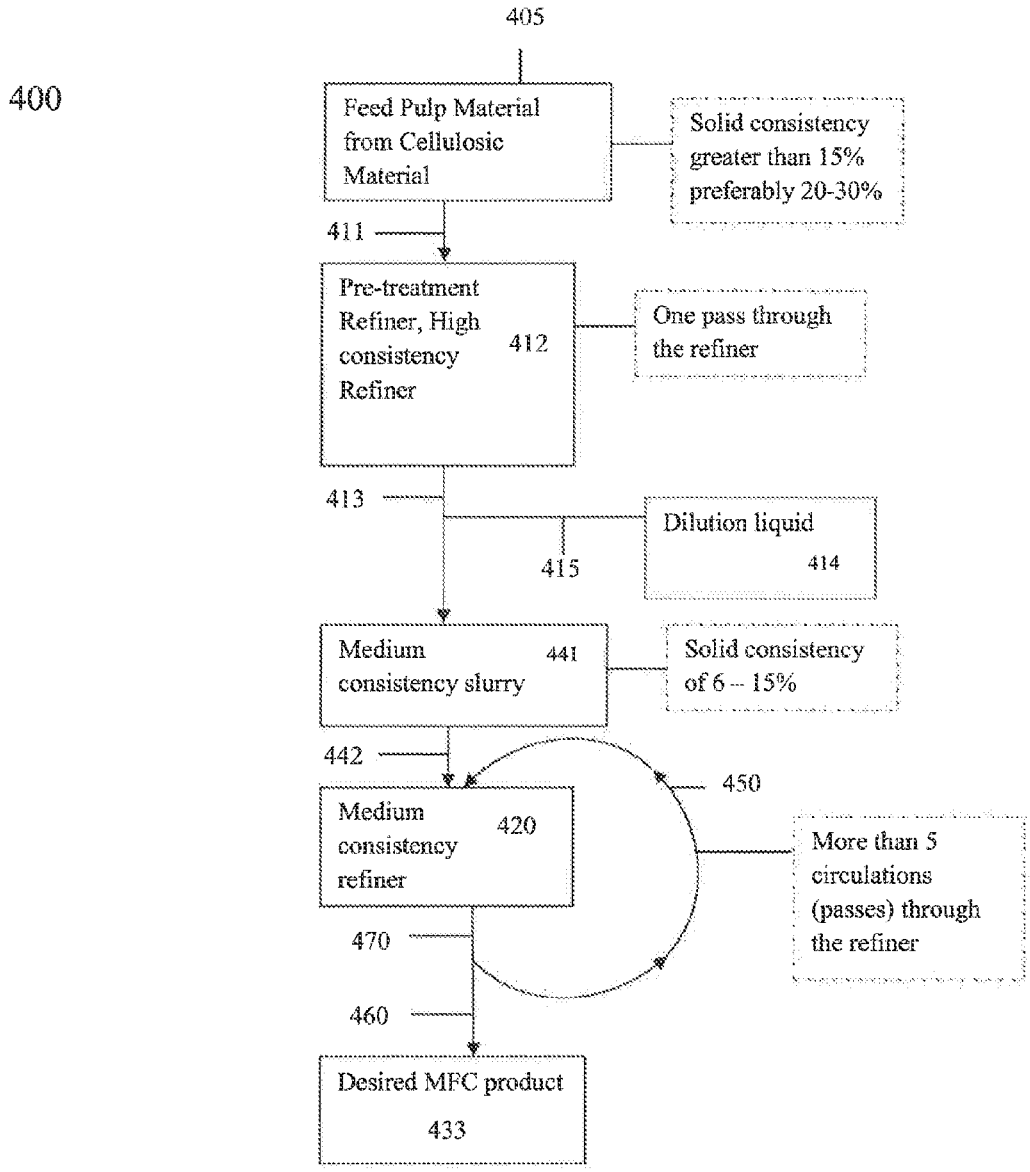
FIG. 4 shows exemplary process flow steps to produce MFC using a combination of high and medium consistency refiners.

FIG. 4 shows a process 400 to produce MFC 400 where a combination of high consistency refiner pre-treatment and medium consistency refiner is used, equipment and streams common to FIGS. 1, 2 and 3 use similar item numbers. The high consistency feed pulp material 405 may be cellulosic material which has been previously treated to produce pulp. High consistency feed pulp material 405 may have a solids consistency of greater than 15%. In some exemplary embodiments, the feed pulp material may have a solids consistency of greater than 20%. In other exemplary embodiments, the feed pulp material may have a solids consistency of greater than 35%. The high consistency feed pulp material 405 may be fed via line 411 to a pre-treatment high consistency refiner 412. Pre-treatment in the pre-treatment high consistency refiner 412 may be a single pass through the pre-treatment high consistency refiner 412. Upon removal from the pre-treatment high consistency refiner 412 via line 413, dilution liquid 414 may be added to pulp material in line 413 via line 415 to form a pre-treated medium consistency slurry 441. The pre-treated medium consistency slurry 441 may have a solids consistency of between 6% and 15%. The pre-treated medium consistency slurry 441 may be fed via line 442 to a medium consistency refiner 420 where the pulp may be separated and fibrillated into small bundles or individual fibers. Medium consistency refiner 420 can be a disc refiner (single or double disc with at least one rotating disc), conical refiner, rotating cylinder refiner, or other refiner capable of handling a mixture of pre-treated solid (pulp) and liquid with a solids consistency of between 6% and 15%, which may be a pre-treated medium consistency slurry 441. The pre-treated medium consistency slurry 441 may enter the inlet of the medium consistency refiner 420 and may move through the refiner to the outlet where it can be removed through line 470 and either returned to the refiner inlet via line 450 or passed through the process via line 460 upon completion of the required passes through the medium consistency refiner 420. Treated medium consistency slurry from the medium consistency refiner 420 may make more than five passes, via line 450, until the desired MFC product is produced and removed from the process via line 460. The final product criteria, typically average fiber length, water absorption, or viscosity may all be considered. MFC product 433 may be sent to a collection reservoir or may undergo subsequent processing.

Figure 5:
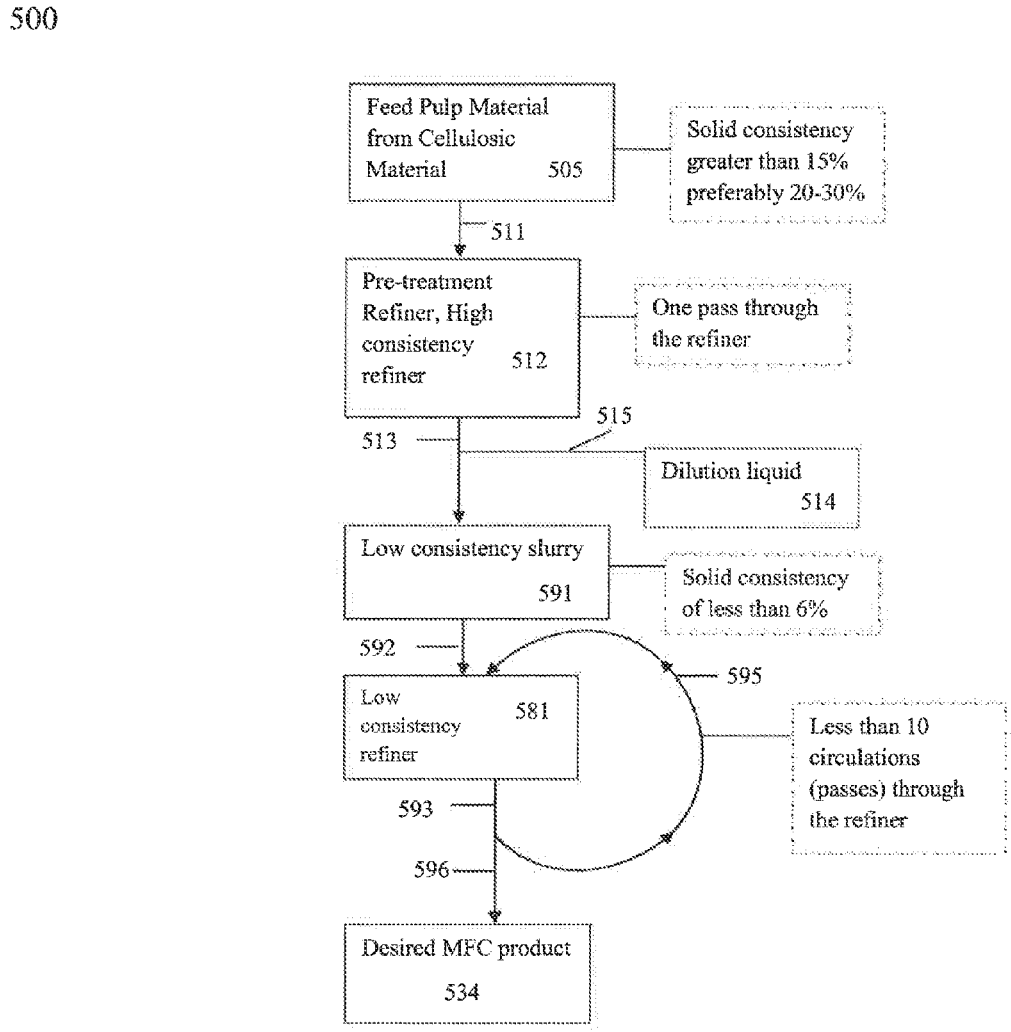
FIG. 5 shows exemplary process flow steps to produce MFC using a combination of high and low consistency refiners.

FIG. 5 shows a process for producing MFC 500 where a combination of high consistency refiner pre-treatment and low consistency refiners are used, equipment and streams common to FIGS. 1, 2, 3 and 4 use similar item numbers. The high consistency feed pulp material 505 may be cellulosic material which has been previously treated to produce pulp. High consistency feed pulp material 505 may have a solids consistency of greater than 15%. In some exemplary embodiments, the high consistency feed pulp material 505 may have a solids consistency of greater than 20%. In other exemplary embodiments, the high consistency feed pulp material 505 may have a solids consistency of greater than 35%. The high consistency feed pulp material 505 may be fed via line 511 to a pre-treatment high consistency refiner 512. Pre-treatment in the high consistency refiner 512 may be a single pass through the high consistency refiner 512. Upon removal from the high consistency refiner 512 via line 513, dilution liquid 514 may be added to pulp material in line 513 via line 515 to form a pre-treated low consistency slurry 591. The pre-treated low consistency slurry 591 may have a solids consistency of less than 6%. The solids consistency may typically be between 1% and 6%. The pre-treated low consistency slurry 591 may be fed via line 592 to a low consistency refiner 581 where the pulp can be separated and fibrillated into small individual fibers and fibrillar elements. Low consistency refiner 581 can be a single or double disc refiner with at least one rotating disc, a conical refiner, a rotating cylinder refiner, or other refiner capable of handling a mixture of pre-treated solid (pulp) and liquid with a solids consistency of between 1% and 6%. The pre-treated low consistency slurry 591 may enter the inlet of the low consistency refiner 581 and can move through the refiner to the outlet where it can be removed through line 593 and is either returned to the refiner inlet via line 595 or continues through the process via line 596 upon completion of the required passes through the low consistency refiner 581. Treated low consistency slurry material from low consistency refiner 581 may make less than ten passes, via line 595, until the desired MFC product is produced. The final product criteria, typically average fiber length, water absorption, or viscosity may all be considered. MFC product 534 may be sent to a collection reservoir or may undergo subsequent processing.

Figure 6:
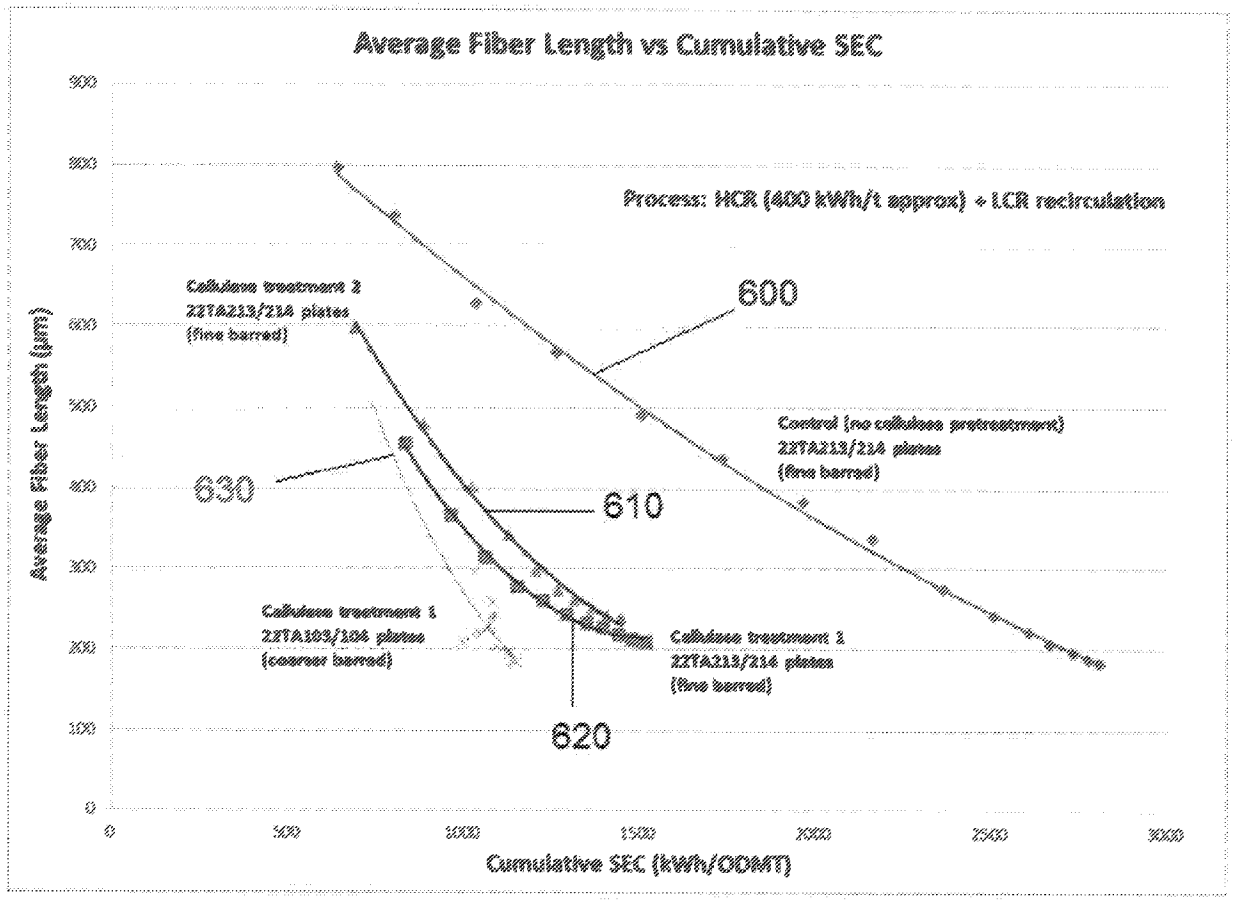
FIG. 6 shows an exemplary relationship between average fiber length and cumulative specific energy consumption ("SEC") for pre-treatment of the pulp slurry with and without the addition enzymes prior to low consistency refining.

FIG. 6 shows the relationship between average fiber length and the cumulative specific energy consumption (SEC) for the process with and without the addition of an enzyme pre-treatment step. This data is collected from a refining evaluation test on softwood cellulose pulp. Specifically, the process using the high consistency refining, where the feed pulp material is pre-treated by a single pass through the high consistency refiner, followed by low consistency refining where the low consistency slurry of pulp is recirculated through the low consistency refiner as shown in FIG. 5 and described above. In these tests, the solids consistency of the pulp slurry was about 3.8% to 3.9% weight percent ("wt. %") as applied to oven-dried fibers from the low consistency pulp slurry. The graph shows four lines. Line 600 represents the process where no enzyme pre-treatment step is used. Lines 610, 620 and 630 all reflect a step of pre-treating the pulp slurry with enzymes, in particular an enzyme in the cellulase family. These enzymes are added to weaken or break the bonds in the cellulose chains of the pulp, thereby enhancing the ability of the refining operation. Lines 610 and 620 represent the average fiber length versus cumulative SEC when using of a cellulase family enzyme in a pre-treatment step of low consistency pulp slurry prior to low consistency refining with fine bar type refiner plates. Line 630 represents the average fiber length versus cumulative SEC when using a cellulase family enzyme in a pre-treatment step of low consistency pulp slurry prior to low consistency refining with coarse bar type refiner plates. In each case, 0.05% wt. % to 0.07% wt. % as applied to oven dried fiber of the pulp slurry of cellulase enzyme was added to the low consistency pulp slurry prior to low consistency refining. However, the concentration of enzyme may be in the range of between 0.02% wt. % to 0.15% wt. % as applied to oven-dried fibers from the low consistency pulp slurry. The pre-treatment, with enzymes, of the low consistency pulp slurry occurred at temperatures of 55° C. and held for about one hour prior to allow for sufficient time for the enzyme and cellulose in the pulp to react.

When the enzymes are used to weaken or break the bonds in the cellulose chain of the pulp, less energy is required to accomplish the desired refining, thus reducing the operating costs of the process. With enzymes of the cellulase family, about 30% to about 60% less energy is consumed when the pre-treatment with enzymes before at least one of medium consistency refining or low consistency refining. In these tests, the control, represented by line 600, had no enzyme pre-treatment and used fine bar type refiner plates. Lines 610 and 620 reflect the tests conducted with an enzyme from the cellulase family using fine bar type refiner plates. The weight percentage varied of enzyme was varied in these two tests. From these tests it is clear the savings in cumulative SEC to obtain a given average fiber length is between about 40% to about 60%, a significant savings in energy. Comparing the test information represented by line 630 to that of the control, line 600, similar energy savings were obtained. The savings in operating costs is significant, even taking into account the additional costs for the enzyme as energy cost savings exceed the cost of the enzymes.

As a result of the tests where an additional pre-treatment step with enzyme prior to low consistency refining, it has been found the additional benefit of the MFC produced having improved transparency properties of a film compared to MFC produced without the enzyme pre-treatment, thereby increasing the value of the MFC produced. The improved film transparency is a result of increased development and separation of the cellulose micro-fibrils into a more uniform product.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A process for producing micro fibrillated cellulose (MFC) material comprising:

a) using a feed pulp material from cellulosic material processed to a high consistency feed pulp having a solids consistency of greater than 15 percent;

b) pre-treating the high consistency feed pulp in a high consistency refiner for a single pass through the high consistency refiner, wherein the pre-treating of the high consistency feed pulp is restricted to a single pass of the high consistency feed pulp through the high consistency refiner;

c) removing the high consistency feed pulp from the high consistency refiner;

d) diluting the high consistency feed pulp to form a medium consistency pulp having a solids consistency of 6 percent to 15 percent;

e) feeding the medium consistency pulp into a medium consistency refiner;

f) using the medium consistency refiner to reduce the fiber length, fibrillate, and separate the fibers into strands and fibrillar elements;

g) removing the medium consistency pulp from the refiner;

h) repeating steps e) through g) at least four times to produce the MFC material, wherein each succession of steps e) through g) uses the removed medium consistency pulp produced by the prior succession of steps e) through g).

2. The process of claim 1 further comprising adding enzymes to the feed pulp prior to step e), wherein the feed pulp is agitated once the enzymes have been added.

3. The process of claim 1 further comprising adding enzymes to the feed pulp prior to step e), wherein the feed pulp is not agitated once the enzymes have been added.

4. The process of claim 1 further comprising the steps of i) diluting the feed pulp material to a low consistency pulp having a solids consistency of less than 6 percent, j) feeding the low consistency pulp into a low consistency refiner, k) using the low consistency refiner to reduce the fiber length, fibrillate, and separate the fibers into strands and fibrillar elements, l) removing the low consistency pulp from the refiner, and m) repeating steps j) through l) less than ten times to produce the WC material, wherein each succession of steps j) through l) uses the removed low consistency pulp produced by the prior succession of steps j) through l).

5. The process of claim 4 further comprising adding enzymes to the feed pulp prior to step i), wherein the feed pulp is agitated once the enzymes have been added.

6. The process of claim 4 further comprising adding enzymes to the feed pulp prior to step i), wherein the feed pulp is not agitated once the enzymes have been added.

7. The process of claim 1, wherein a single refiner is used for both the medium and low consistency refining.

* * * * *